US006736284B2

(12) United States Patent
Werth et al.

(10) Patent No.: US 6,736,284 B2
(45) Date of Patent: May 18, 2004

(54) END CLOSURE STRUCTURE AND METHOD AND CONTAINER HAVING REINFORCING RIB STRUCTURES

(76) Inventors: Elmer D. Werth, 7025 W. 61st Ave., Arvada, CO (US) 80003; Roger A. Hahn, 16576 W. 51st Pl., Golden, CO (US) 80403

( * ) Notice: Subject to any disclaimer, the term of this patent is extended or adjusted under 35 U.S.C. 154(b) by 0 days.

(21) Appl. No.: 09/981,773

(22) Filed: Oct. 16, 2001

(65) Prior Publication Data

US 2003/0071044 A1 Apr. 17, 2003

(51) Int. Cl.[7] ..... B65D 6/30
(52) U.S. Cl. ..... 220/623; 220/619; 220/620
(58) Field of Search ..... 220/623, 615, 220/618, 619, 620, 608, 366.1, 648

(56) References Cited

U.S. PATENT DOCUMENTS 2,321,408 A * 6/1943 Mills et al. ..... 220/619 X
4,108,324 A * 8/1978 Krishnakumar et al. 220/608 X
4,525,401 A * 6/1985 Pocock et al. ..... 220/608 X
5,938,067 A * 8/1999 Diamond et al. ..... 220/623 X

* cited by examiner

*Primary Examiner*—Stephen Castellano
(74) *Attorney, Agent, or Firm*—Timothy J. Martin; Michael R. Henson; Rebecca A. Gegick

(57) ABSTRACT

An end closure for a container, such as a beverage or food can, includes a transverse central body panel and a surrounding outer margin joined to the longitudinal side wall of the container body. The margin portion has a support section, and a plurality of spaced rib structures are located on the margin and have portions that extend longitudinally along the support section to reinforce the margin. The end closure can be a lid or an integrally formed bottom for a can body. The margin can have a U-shaped profile with the rib structures located on either the inner or outer wall portion thereof. The rib structures may be flutes defining tear-dropped shaped depressions. The invention contemplates a can body with the end closure forming the bottom thereof. A method is described for forming such end closures and containers.

26 Claims, 6 Drawing Sheets

END CLOSURE STRUCTURE AND METHOD AND CONTAINER HAVING REINFORCING RIB STRUCTURES

FIELD OF THE INVENTION

The present invention broadly relates to the manufacture of containers, especially drawn and ironed containers made of steel or aluminum, such as those used in the food and beverage industry. More particularly, the present invention concerns the formation of a margin profile for an end closure that includes reinforcing rib structures the invention concerns both container lids and can bodies including integral domed end closures.

BACKGROUND OF THE INVENTION

The need for packaging of food and beverage products for storage and sale has increased with the increase in human populations and as urbanization has intensified. In addition, the demand for convenient, ready-to-eat products have added to the demand for suitable packaging. A long standing technique for packaging certain foods and beverages is metal cans. Such cans take a variety of geometric shapes and are often produced out of drawn and ironed steel or aluminum. Typically, these containers are either circular, oval, or rectangular (including square) in cross-section and are used to package a wide variety of liquid beverages, fruit and vegetables, meat products, dehydrated foods, etc.

The rising demand for steel and aluminum containers, though, carries certain concerns about production costs and the quantity of material used in the fabrication process. Accordingly, there have been intensified efforts to reduce the wall diameter of steel and aluminum cans in order to reduce the weight and mass of raw material used to create a can of given volume. This saves in the costs of production in two ways. By reducing the quantity of material, lower raw material costs result. Moreover, the energy required to refine or recycle the material is reduced. Another advantage is a reduction in the need for virgin raw materials that must be extracted from the natural resource base. Indeed, due to the volume of cans, such as aluminum cans for example, even a very minor reduction in wall thickness can result in literally tens of millions of dollars in savings on an annualized base. This is additionally true if there can be a reduction in thickness of an aluminum lid that is typically seamed onto an aluminum can body since the seamed lid is substantially thicker than the can body.

Nonetheless, the reduction in wall thickness of containers is not without its problems. While a reduced wall thickness is highly desirable from a material standpoint, structural integrity of the container must be maintained. Since the reduced wall thickness of a container diminishes its inherent strength, improved geometries have been developed to give added strength of the design. An example of such a geometry in the beverage industry, is the formation of a concaved depression in the bottom of an aluminum can with this concaved depression being commonly referred to as a "dome".

Providing the bottom of a container with an axial, internally extending dome has several advantages. The margin of the dome provides a U-shaped profile that increases the structural rigidity of the container, especially where the internal contents of the container are pressurized. The provision of a dome on such a container has allowed manufacturers to maintain adequate side wall and end wall strengths while reducing the thickness of the can blank material.

This is of particular importance to the beverage industry where carbonated beverages are packaged in the container for storage and sale. Here, the dome structure greatly increases the resistance of the container to expansion or "bloating" so as to maintain integrity of the container while at the same time maintaining the contents of the container at the desired pressurized state. The lids that are seamed upon such can bodies also have a U-shaped margin that provides structural rigidity to the can.

In the typical production of a beverage can, a can blank is produced by stamping a cup-shaped blank out of sheet material. This cup-shaped blank has a bottom wall and side wall thickness that is greater than the thickness of the can to be produced, but the physical dimensions of the cup-shaped can blank are smaller than the can to be produced. The production blank is placed in an ironing device wherein a punch advances the can blank through drawing and ironing dies which configure the can blank into the final dimensions of the desired container. This is accomplished by stretching or "ironing" the metal side walls of the can blank to increase its axial dimension while thinning the wall thickness to compensate for the increase in height. This device is commonly referred to as a "body maker". After the can body is created, a dome is configured in the integrally formed body end closure by a "domer". The domer can be associated with the body maker or can be a separate device. Where associated with the body maker, the bottom dome structure is formed at the end of the draw and iron cycle. Alternatively, the can body may be placed in a separate doming machine. In either case, a punch strikes the bottom end closure against a die structure that is configured to match the dome shape of the punch thereby to stamp the bottom profile in the container.

Even though significant advances have occurred in the formation of container structures, there needs to be continued advancement in this art in an effort to achieve the accommodates noted above. There is a continuing need for end closures, can bodies, containers and methods which allow the further reduction in material consumption without otherwise significantly compromising the integrity of the container system. The present invention is directed to these issues.

SUMMARY OF THE INVENTION

It is an object of the present invention to provide a new and useful end closure for a container where the amount of material used in construction is reduced yet where the structural integrity of the container is maintained.

It is another object of the present invention to provide a container with end closures, either in the form of a lid or an integrally formed bottom wall, that have improved strength.

It is yet another object of the present invention to provide a can body with a domed end closure of improved configuration for strength that may then be used to form a container.

Still a further object of the present invention is to provide a new and useful method of forming an end closure for a surrounding side wall of a container as well as a method for forming a canned body for such a container.

Yet a further object of the present invention is to provide for the possible reduction of materials used to form container, can bodies and end closures for such containers.

According to the present invention, then, an improvement is provided for a container that has a surrounding side wall forming a container body with a central axis and first and second end closures that define an interior. The improvement broadly includes at least one end closure for the container.

The end closure has a central body panel oriented transversely to the central axis and an outer surrounding margin portion joined to the side wall. The margin portion includes a support section thereof that is oriented longitudinally relative to the container body. A plurality of rib structures are disposed on the margin and have longitudinally extending components located on the support section and positioned and spaced-apart relation therearound.

The rib structures are corrugated in nature and may be formed as flutes in the support section. Thus, the rib structures have trough regions separated by ridge portions. The trough regions, in one embodiment, are formed as tear-dropped shaped depressions in the support section. In another embodiment, the rib structures include a radial rib component disposed on the central body panel.

The margin portion of the enclosure may have a U-shaped profile to include an inner wall portion and an outer wall portion. The rib structures may be disposed either on the outer wall portion or on the inner wall portion. Where the end closure is an integrally formed bottom for the container body, formed as a one-piece construction with a side wall, the rib structures, for example, may be disposed on the inner wall portion. The rib structures may be equidistantly spaced from one another.

The support section on the margin portion of the central body panel may be a shell formed as a truncated geometric shape. This geometric shape may be cone or a pyramid having a polygonal base of "n" sides where "n" is an integer greater than two. As noted, the enclosure may be formed integrally with these side walls or, alternatively, may be a lid that is joined to the container body by a mechanical joint. The container body likewise may have a cross-section that is selected from a group consisting of circles, ovals and n-sided polygons where "n" is an integer greater than two. The central body panel can have a geometrical shape that is geometrically similar to the cross-section of the container body.

The present invention is also directed to a can body adapted to receive contents for packaging. The can body has a surrounding side wall portion having a central axis and a bottom closure joined to the side wall portion to enclose an end of the can body. The bottom closure includes a central body panel oriented transversely to the central axis and an outer surrounding margin portion joined to the side wall. This margin portion has a support section oriented longitudinally relative to the surrounding side wall body. A plurality of rib structures are then disposed in the margin and have longitudinally extending first rib components. These first rib components are located on the support section and are positioned in spaced-apart relation about the support section.

Here, again, the margin portion can have a U-shaped profile including an inner wall portion and an outer wall portion. The first rib component may be then disposed on the inner wall portion. Moreover, the inner wall portion may be formed as a truncated geometric shape, as described above. The first rib components can be flutes, such as tear-dropped shaped depressions in the support section. The other structures discussed above, can apply to this can body, as well. Where the can body is cylindrical, the rib components may be equiangularly spaced from one another. The invention also includes a container having a second end closure joined thereto that is opposite the first end closure.

The present invention also concerns a method of forming an end closure for a surrounding side wall of a container having a central axis. This method includes all of the steps inherent in the containers and can body noted above. The method can include a step of forming a central body panel oriented transversely to the central axis and an outer surrounding margin portion joined to the side wall with the margin portion having a support section oriented longitudinally relative to the side wall. The method can include the step of corrugating a portion of the margin to provide rib structures. At least some of the rib structures have longitudinally extending first rib components located on a support section. The method can also include the step of forming the support section as a truncated geometric shape, and this geometric shape may be a cone, or a pyramid having a polyigamol base of "n" sides where an "n" is an integer greater than two. The method can also include the configuring of the outer margin portion in a U-shaped profile to include an inner wall portion and an outer wall portion. The step of corrugating can be accomplished by forming the rib structures on the outer wall portion. Alternatively, the step of corrugating can be accomplished by forming the rib structures on the inner wall portion. The step of corrugating may be accomplished by forming flutes in the support section with these flutes, in one embodiment, being tear-dropped shaped depressions in the support section. The method can also include the formation of radial second rib components that are disposed on the central body panel.

The present invention is also directed to a method of forming a can body out of a cup-shaped can blank. Here, the method includes the step of ironing the can blank to form a surrounding side wall portion having a central axis and doming a bottom portion of the can blank. The doming of the bottom portion can be done to create a central body panel oriented transversely to the central axis and an outer surrounding margin portion joined to the side wall portion. The margin portion has a support section oriented longitudinally relative to the surrounding side wall body. The method can include the step of corrugating a portion of the margin to provide a rib structure having longitudinally extending first rib components located on the support section. This method can include the additional steps described, above, with respect to the formation of an enclosure.

These and other objects of the present invention will become more readily appreciated and understood from a consideration of the following detailed description of the exemplary embodiment of the present invention when taken together with the accompanying drawings, in which:

DETAILED DESCRIPTION OF THE EXEMPLARY EMBODIMENTS

The present invention is broadly directed to containers that have surrounding side walls and end closures to define an interior which may receive contents for packaging. The present invention especially concerns containers that are used in the food and beverage industry such as those formed out of steel, aluminum or other metal. While several embodiments of the present invention are described with respect to cylindrical cans, it should be understood at the outset that the present invention may be employed on containers having a variety of geometrical shapes, configurations and cross-sections so that it is in no way intended to be limited to cylindrical cans.

Figure 1:
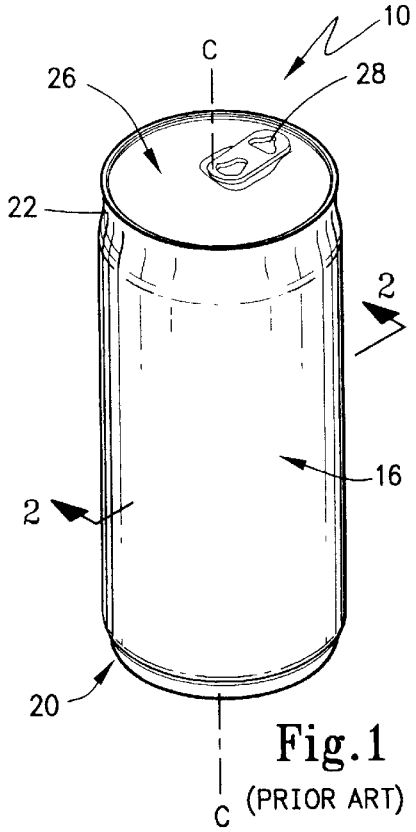
Fig.1 (PRIOR ART)
FIG. 1 is a perspective view of a representative container, in the form of a representative container, in the form of a cylindrical beverage can, according to the prior art.
Figure 2:
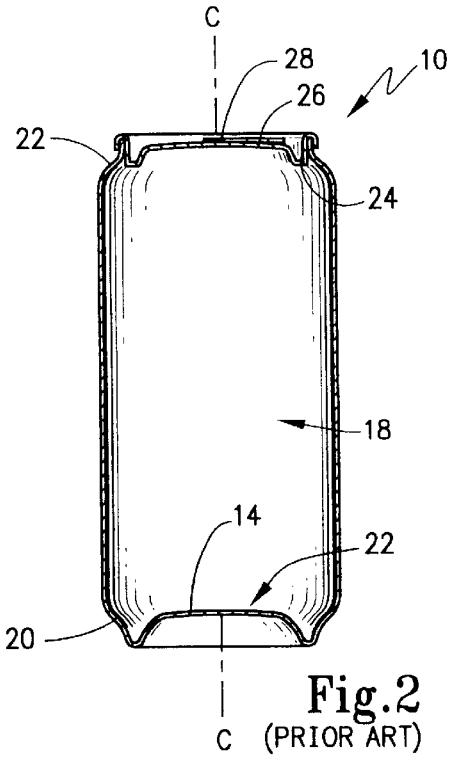
Fig.2 (PRIOR ART)
FIG. 2 is a cross-sectional view taken about lines 2—2 of FIG. 1 showing the prior art container (without any contents therein)

With this in mind, a representative beverage container 10 according to the prior art is introduced in FIGS. 1 and 2. Container 10 has a surrounding side wall 12 and a first end closure 14 that is formed integrally therewith to define a can body 16 having an interior 18 wherein contents for packaging may be placed. As is shown in FIGS. 1 and 2, can body 16 and thus container 10 has a central axis "C" with side wall 12 being formed, generally, as a cylindrical shell. A lower portion 20 of can body 16 tapers inwardly and includes a dome 22 to increase the rigidity and the resistance of the can body to "bloat" when pressurized contents are placed therein. An upper portion 22 of can body 12 is necked, again as is known in the art, to reduce the diameter of can body 16 at mouth 24. Mouth 24 is formed as a rim, and second end closure in the form of lid 26 is seamed onto mouth 24 after the contents have been placed therein. When the container is to be used for containing beverages, the lid 26 is typically provided with a pull tab, such as pull tab 28. Together, first end closure 14 and the second end closure, in the form of lid 26, enclose interior 18 with lid 26 being axially spaced from first end closure 14 along central axis "C".

Figure 3:
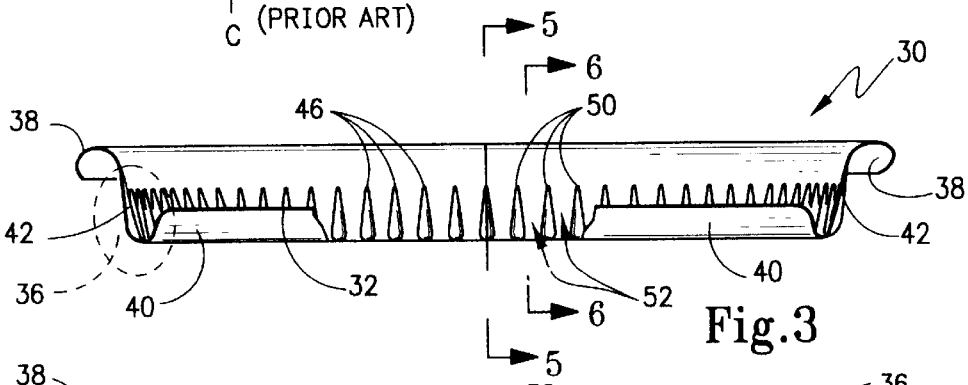
FIG. 3 is a side view in partial cross-section and partially broken-away showing an end closure according to one exemplary embodiment of the present invention in the form of a lid for the container of FIG. 1.

A first exemplary embodiment of the present invention is introduced in FIG. 3 in the form of lid 30 which may be seamed onto a can body, such as can body 16, in a manner similar to lid 26 to form a completed container. Lid 30 includes a central body panel 32 that supports a pull tab 34 as was the case with pull tab 28 of lid 26. Single body panel 32, like lid 26, is adapted to be oriented transversely to the central axis "C" of can body 16. By "transverse" it is meant that the panel can extend across mouth 24 in order to enclose interior 18 and may be perpendicular or oblique to axis "C". Lid 30 includes an outer surrounding margin portion 36 that is adapted to be joined to side wall 12 of can body 16 by seaming, in a manner that is the same as lid 26 and as is known to the ordinarily skilled person in the can seaming art. To this end, lid 30 is provided with a lip 38 which may be seamed onto the upper edge of can body 16 that defines mouth 24.

Figure 5:
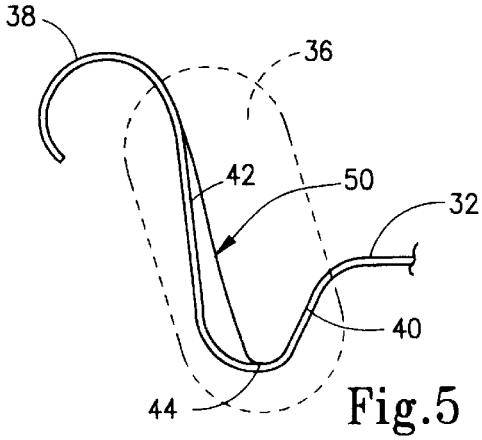
FIG. 5 is a side view in cross-section showing the outer surrounding margin portion of the lid of FIG. 3, taken about lines 5—5 of FIG. 3.
Figure 6:
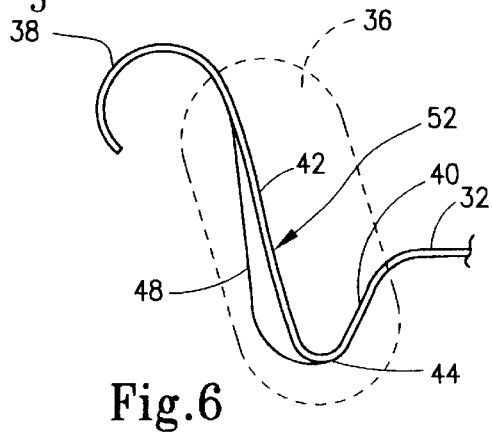
FIG. 6 is a cross-sectional view, similar to FIG. 5, but taken about lines 6—6 of FIG. 3.

With reference to FIGS. 3, 5 and 6, it may be seen that outer margin portion 36 has a U-shaped profile to include an inner wall portion 40 and an outer wall portion 42 joined by connecting wall 44. Walls 40 and 42 provide support sections that, when lid 30 is seamed onto can body 16, will be oriented longitudinally relative to the container body 16. By "longitudinally" it is meant that the support section has a dimension that extends in the direction of axis "C".

A plurality of rib structures are disposed on outer margin portion 36 and have longitudinally extending first rib components located on the support section. Thus, for example, in FIGS. 3, 5 and 6, a plurality of rib structures 46 are shown as tear-dropped shaped depressions formed in outer wall portion 42 these depressions 48 therefore define flutes that act to corrugate outer wall portion 42 with alternating longitudinally extending trough portions 50 separated by ridge portions 52, i.e., that is not perpendicular to axis "C".

With continued reference to FIGS. 3, 5 and 6, it may be seen that the support section formed by each of inner wall portion 40 and, especially, outer wall portion 42, has a truncated geometric shape. For example, where can body 16 is cylindrical, so that it is circular in cross-section, central body panel 32 is circular in shape so that it is geometrically similar to the cross-section of can body 16. Thus, inner wall portion 40 is a frustoconical shell. Likewise, outer wall portion 42 is an inverted frustoconical shell.

As noted above, however, it is not the intent of this description to limit in any way the geometric cross-section of containers and can bodies are covered by this invention. Thus, for example, the container body may easily have a cross-section selected from a group consisting of circles, ovals and n-sided polygons where "n" is an integer greater than two. Where the central body panel, such as central body panel 32 is as a geometrical shape that is geometrically similar to the cross-section of the container body, then, the truncated geometric shape of the support section may be selected from a group consisting of truncated cones having bases that are either circles or ovals and truncated pyramids where the pyramids have a polygonal base of "n" sides with "n" being an integer greater than two.

Figure 4:
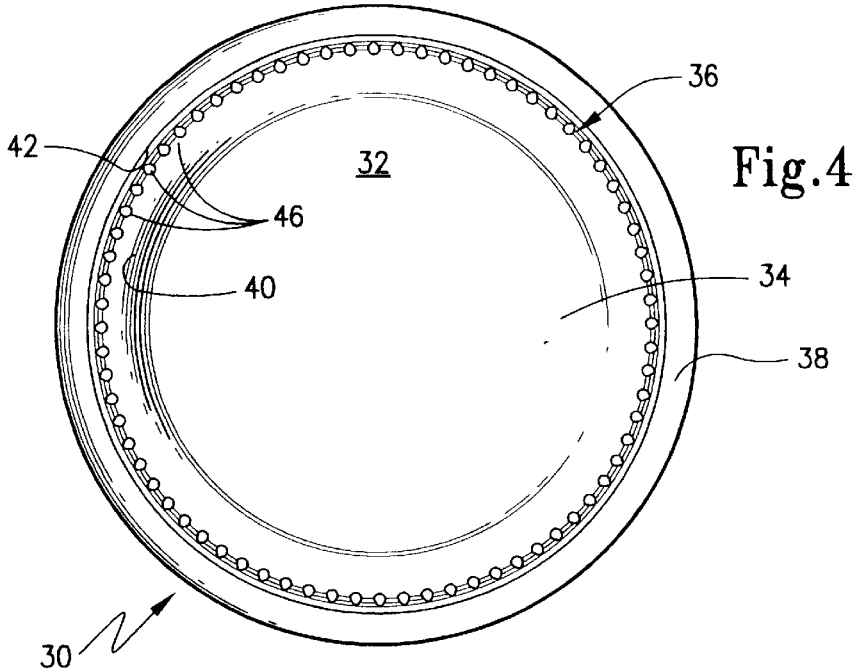
FIG. 4 is a top plan view of the lid shown in FIG. 3.

With reference to FIGS. 3 and 4, it may be seen that the rib structures 46 formed by depressions 48 thus have rib components that are positioned and spaced apart relation around the circumference of outer wall portion 42. As is seen in FIG. 4, this spacing is preferably both equidistant and equiangular so that a uniform array of rib structures 46 are provided.

Figure 7:
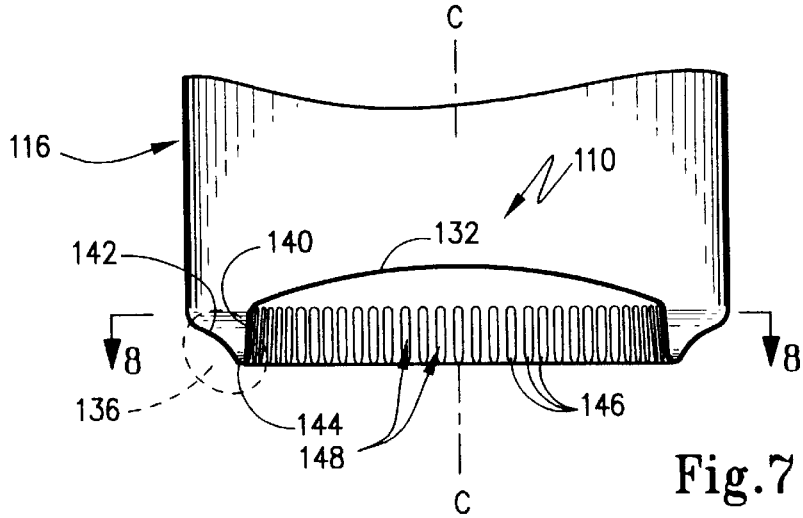
FIG. 7 is a side view in cross-section of the domed end closure of the container of FIG. 1.
Figure 8:
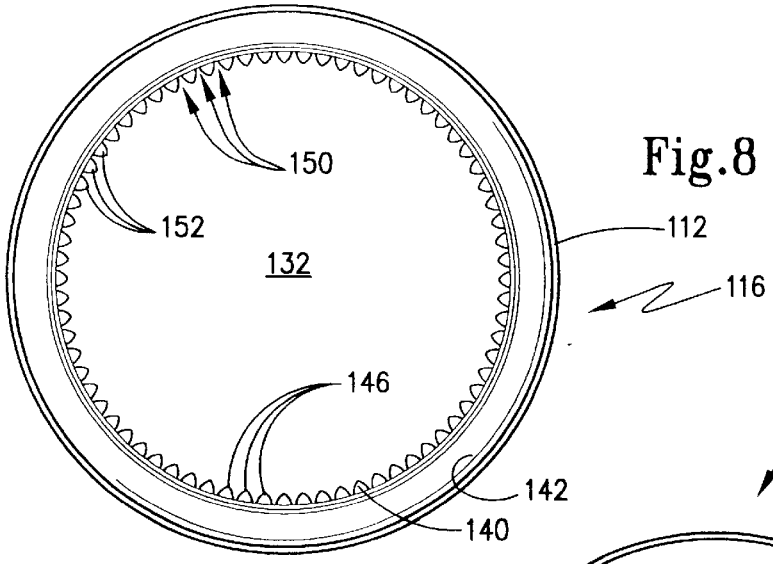
FIG. 8 is a cross-sectional view taken about lines 8—8 of FIG. 7.

Turning to FIGS. 7 and 8, a second embodiment of an end closure according to the present invention is shown. Here, can body 116 has an end closure in the form of a domed bottom 110 that includes a dome-shaped central body panel 132 that extends transversely of central axis "C". Domed bottom 110 provides an end closure that is opposite the end where the lid, such as lid 26 or 30, is seamed onto the container. Central body panel 132 has an outer surrounding margin portion 136 that is generally U-shaped in configuration and includes an inner wall portion 140 that is oriented generally parallel to axis "C" and that is joined to an outer wall portion 142 by connecting wall 144. Walls 140 and 142 again provide a support section that is oriented longitudinally relative to the container body and a plurality of rib structures 146 are again provided. Here, wall portions 140, 142 and 144 along with central body panel 136 are formed integrally with side wall 112 of can body 116 as an integral, one-piece construction. Rib structures 146 are formed on the inner wall portion 140 and, with reference to FIG. 8, it may be seen that rib structures 146 are equidistantly and equiangularly spaced from one another. Rib structures 146 are again formed by depressions 148 (FIG. 7) so that there are alternating troughs 150 and ridges 152, as is shown in FIG. 8.

Figure 9:
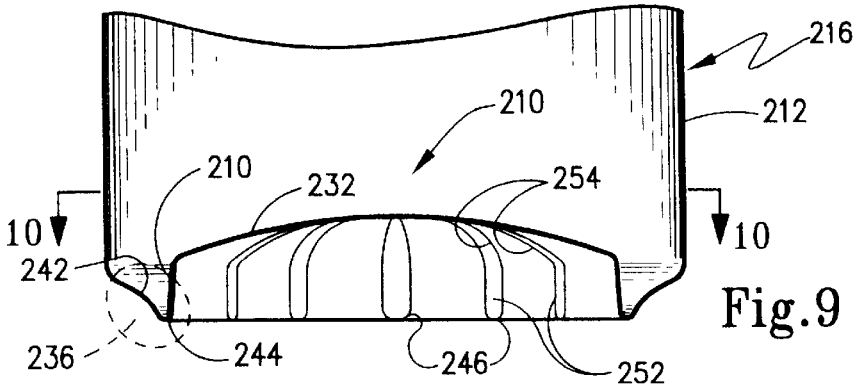
FIG. 9 is a cross-sectional view, similar to FIG. 7, but showing yet another exemplary embodiment of the present invention employed on an end closure for the container of FIG. 1.
Figure 10:
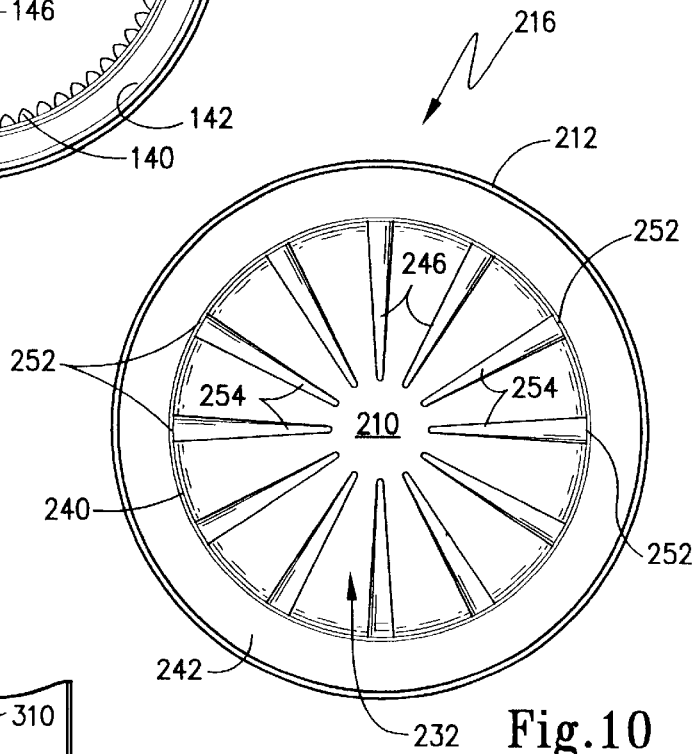
FIG. 10 is a cross-sectional view taken about lines 10—10 of FIG. 9.

A third embodiment of the present invention is shown in FIGS. 9 and 10. Here, can body 216 has a side wall 212 to which a domed end closure 210 is formed integrally as a one-piece construction therewith. To this end, domed end closure has a central body panel 232 that has an outer margin portion 236 that includes an inner wall portion 240 joined to an outer wall portion 242 by means of a connecting wall 244 to form a generally U-shaped profile. A plurality of rib structures 246 are again equidistantly and equiangularly spaced around dome end closure 210. To this end, rib structures 246 have first rib components 252 that are formed in inner wall portion 240 with second rib components 254 extending onto central body panel portion 232.

Figure 11:
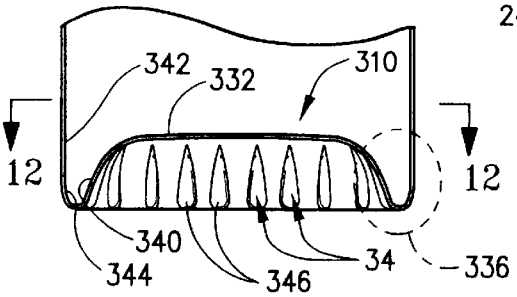
FIG. 11 is a cross-sectional view, similar to FIGS. 7 and 9, but showing a domed end closure for a container having an alternative cross-section (i.e., rectangular) container body.
Figure 12:
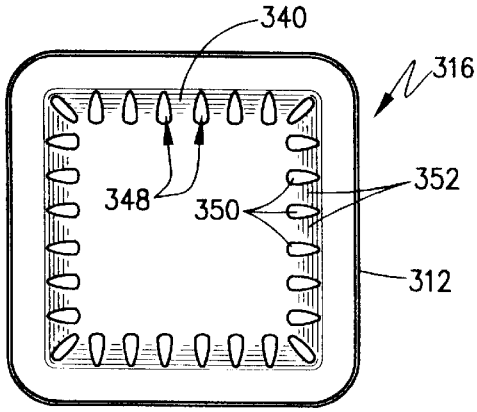
FIG. 12 is a cross-sectional view taken about lines 12—12 of FIG. 11.

A fourth embodiment of the present invention is shown in FIGS. 11 and 12. With reference to these Figures, then, it may be seen that a can body 316 has a side wall 312 which has a rectangular (in this instance square) in cross-section. Can body 316 has a domed end closure 310 including a central body 332. Outer margin portion 336 is formed by an inner wall portion 340 joined to an outer wall portion 342 by means of a connecting wall 344 in a manner similar to that described with respect to FIGS. 7–10. Here, inner wall portion 340 is a truncated pyramid and is provided with a plurality of rib structures 346 formed as tear-dropped depressions 348 formed in inner wall 340. Depressions 348 again form troughs 350 that are separated by ridges 352. A structure shown in FIGS. 11 and 12 is to illustrate that the can body according to the present invention as well as the resulting container can have a different geometric cross-section than the cylindrical cross-section shown in FIGS. 1–10. Here, again, central body panel 332 would be formed to have a geometrically similar shape as the cross-section of can body 316.

Figure 13:
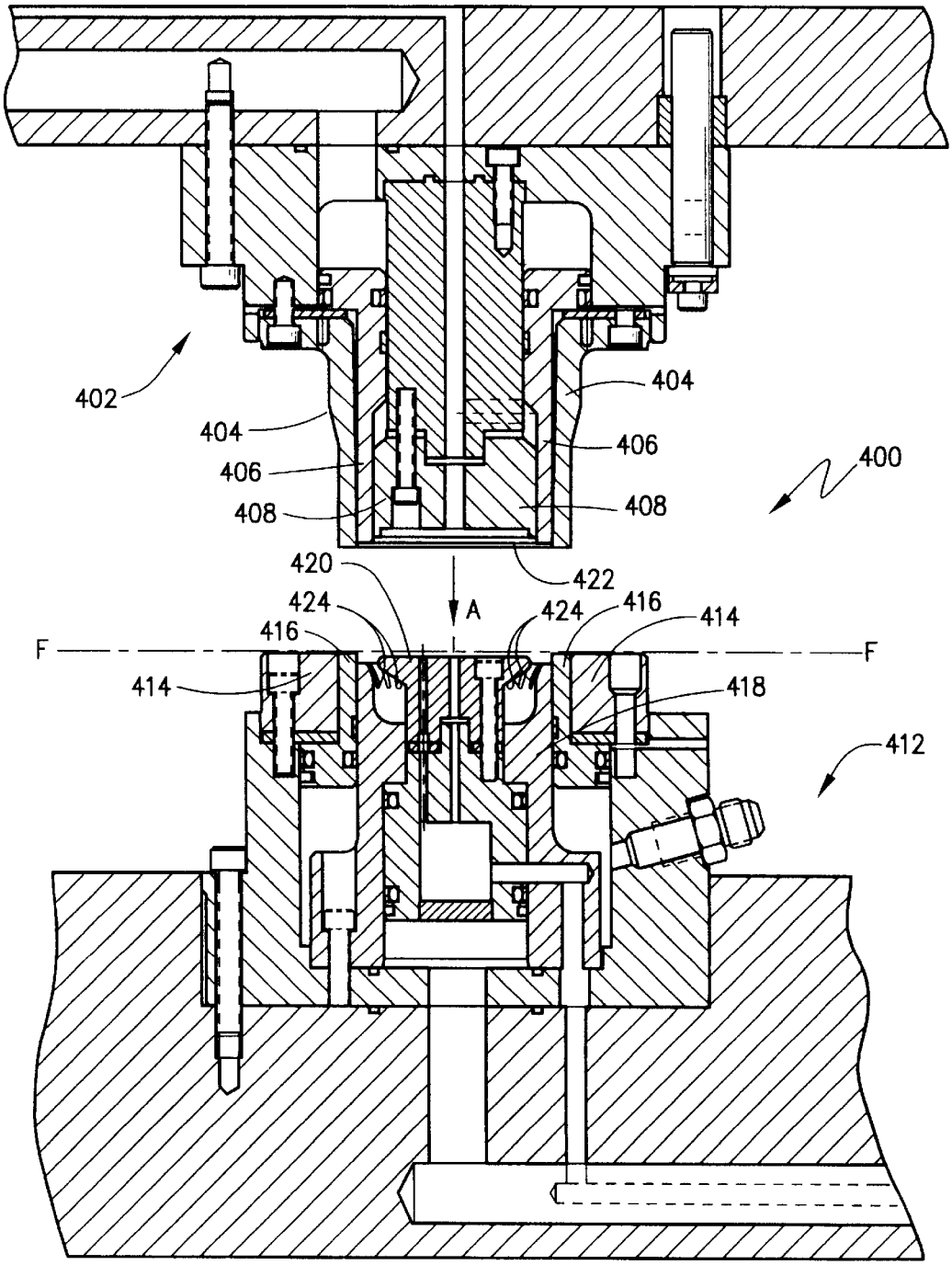
FIG. 13 is a side view in cross-section showing a lid forming apparatus and an open configuration for a machine adapted to form the lip ??, the enclosure in the form of a lid as shown in FIGS. 3–6.
Figure 14:
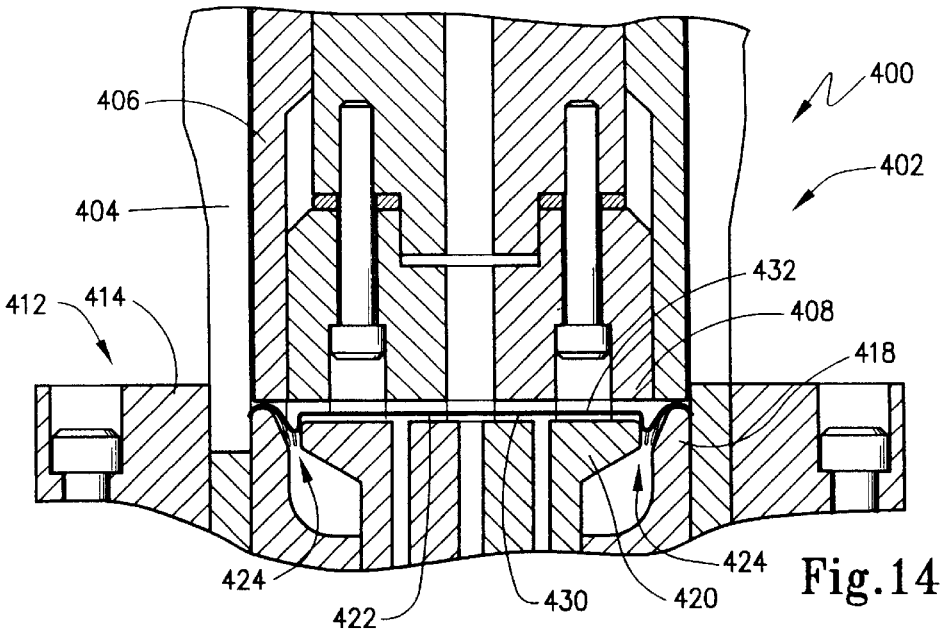
FIG. 14 is a side view in cross-section of the machinery of FIG. 13, in a closed position.

With reference now to FIGS. 13 and 14, a mechanism as is known in the art is provided for the formation of an end closure of the type shown in FIG. 3. In FIGS. 13 and 14, the lid forming machine 400 is illustrated. In FIG. 13, lid forming machine 400 is in the open configuration. Here, it may be seen that an upper section 402 of the machine carries a blanking punch 404 along with a top pressure ring 406 and a top panel forming punch 408. A sheet of stock material is placed in forming plane "F" which is at the upper surface of a bottom forming section 412. Bottom section 412 supports a blanking die 414, a bottom pressure ring 416, an outer countersink die 418 and an inside counterpunch 420. With reference again to FIG. 13, but also in reference to FIG. 14, which shows the lid forming machine 400 in a closed state, it may be seen that top section 402 has advanced into bottom section 412. As this occurs, a lid blank, which is disk-shaped in configuration for a cylindrical container, is sheared between blanking punch 404 and blanking die 414. Inside countersink punch 420 stamps the central body panel 432 against surface 422. The peripheral margin of the lid blank is formed with the desired profile by means of the interaction of outside countersink die 418 and top panel forming punch 408. Protrusions 424 are disposed around the surface of outside countersink die 418 and interact with the top panel forming punch 408 to form the rib structures for the lid as described above. Here, it should be understood that the apparatus illustrated in FIGS. 13 and 14 are standard in the industry except that, in the present invention, it is necessary to provide protrusions 424 that form the ridge structures on lid 430.

Figure 15:
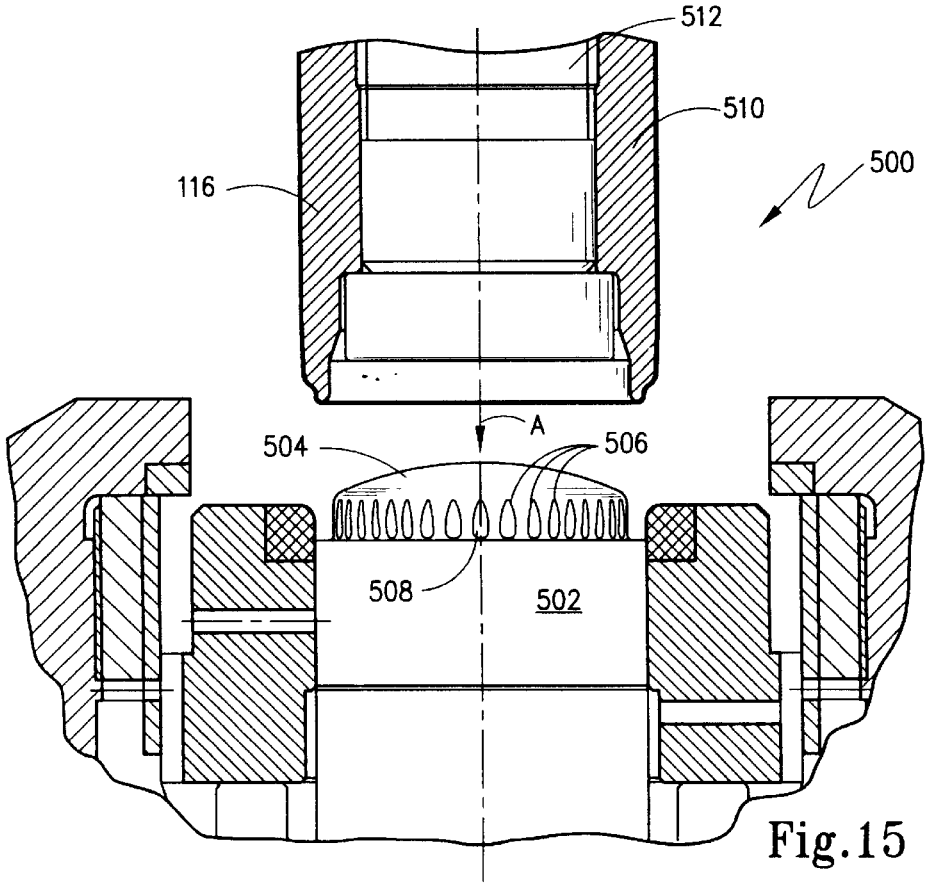
FIG. 15 is a side view in partial cross-section showing a doming apparatus for producing the end closures of FIGS. 7 and 8 in an open position.
Figure 16:
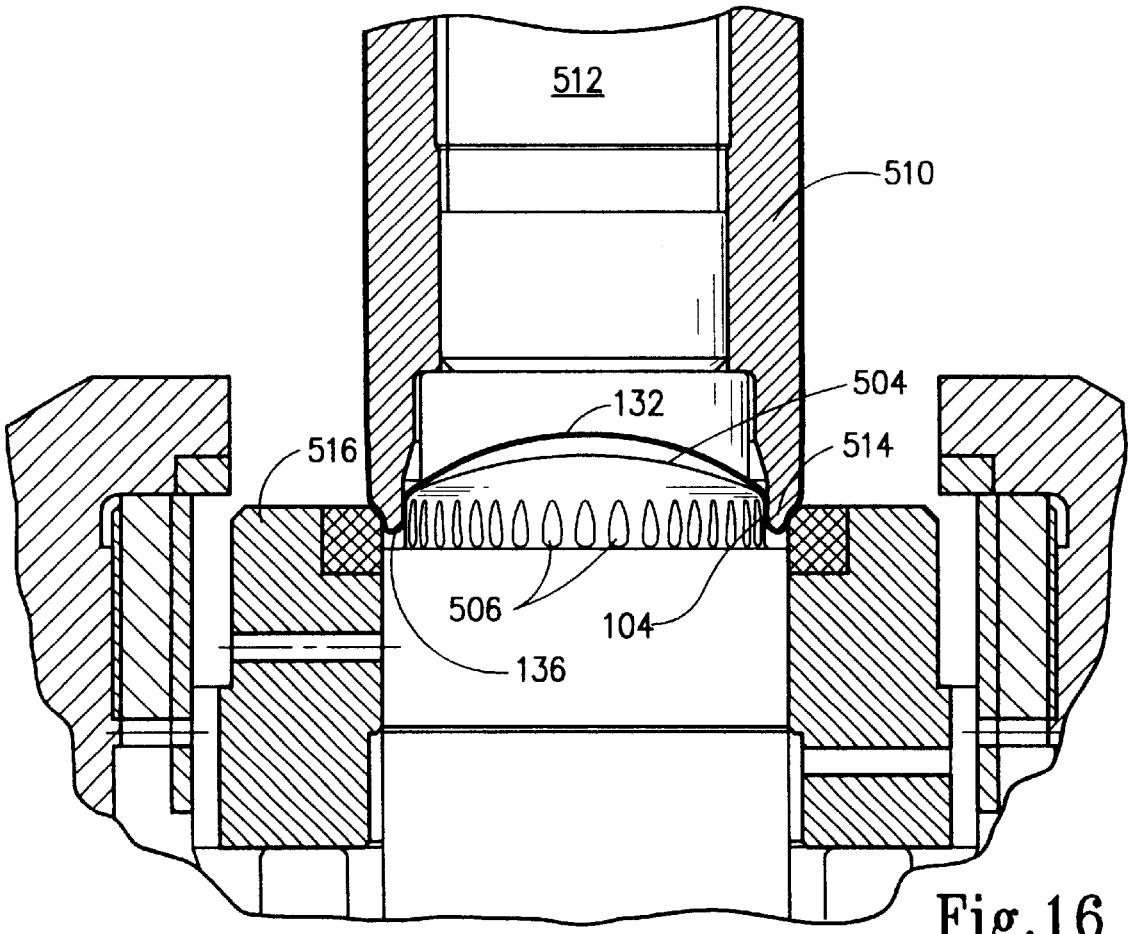
FIG. 16 is a side view in partial cross-section of the doming apparatus of FIG. 15 shown in a closed position.

With reference now to FIGS. 15 and 16, a typical doming machine is shown in an open position (FIG. 15) and a closed position (FIG. 16) to form a domed can body of a type shown in FIGS. 7 and 8. Here, doming machine 500 has been modified to include a doming die 502 that has an upper dome-shaped surface 504 and a plurality of protrusions 506 extending therearound and equidistantly spaced along outer wall 508. Protrusions 506 are operative to create the depressions to form the rib structures 146 noted above.

To this end, can body 116 is carried on a forming punch 510, as is known in the art, that also carries body maker ram 512. Forming punch 510 travels in the direction of arrow "A" so that can body 116 is advanced towards doming die 502. As this travel occurs, the lower panel 132 is pressed upon dome surface 504 and profile 514 advances into engagement with pressure ring 516 to form outer margin portion 136. When this occurs, inner wall portion 140 is pressed against protrusions 506 to corrugate the rib structures noted above. The structure of doming machine 500 is of a type well-known in the art with the exception of doming die 502 and profile 514 have been modified for purposes of forming the rib structures according to the present invention.

From the foregoing, it should be appreciated that the present invention is directed to a method of forming an end closure for a surrounding side wall of a container that includes any of the steps inherent in the above described structures. Broadly, the method includes the step of forming a central body panel that is oriented transversely to the central axis of the container with this central body panel having an outer surrounding margin portion joined at the side wall. The margin portion has a support sections oriented longitudinally relative to the side wall. The method also includes the step of corrugating a portion of the margin to provide rib structures at least some of which each having a longitudinally extending component located on the support structure.

In the method, the support section can be formed either as a truncated geometric shape or parallel to the central axis. Where the support structure is truncated, it may be selected from a group consisting of cones and pyramids having a polygonal base of "n" sides where "n" is an integer greater than two. The outer margin portion may be configured into a U-shaped profile to include an inner wall portion and an outer wall portion. In this event, the step of corrugating may alternatively be accomplished by forming the rib structure on either the outer wall portion or the inner wall portion. In this method, the step of corrugating is accomplished by forming flutes in the support section, and these flutes may be tear-drop shaped depressions. The rib components according to the method may be equidistantly and/or equiangularly spaced from one another and, if desired, the rib structures can include second components disposed along the central body panel of the end closure.

The method of the present invention can also be directed to forming a can body out of a can blank. Here, the method includes the step of ironing the can blank to form a surrounding side wall portion having a central axis. A bottom portion of can blank is domed to create a central body panel oriented transversely to the central axis and an outer surrounding margin portion joined to the side wall portion. This margin portion has a support section thereof that is oriented longitudinally relative to the surrounding side wall body. This method of forming a can body also includes the step of corrugating a portion of the margin to provide a rib structure having longitudinally extending first rib components located on the support section.

Here, again, the method forming the can body can includes the step of forming the outer margin portion by configuring into a U-shaped profile including an inner wall portion and an outer wall portion and wherein the step of corrugating is accomplished by forming the rib structures on the inner wall portion. The step of corrugating can be accomplished by forming flutes in the support section, and the first rib components can be again equidistantly spaced from one another.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

We claim:

1. In a container having a surrounding side wall forming a container body that has a longitudinally extending central axis and first and second end closures defining an interior therein, an improvement wherein at least one of said end closures includes:

(A) a central body panel oriented transversely to the central axis and (B) an outer surrounding margin portion joined to said side wall, (1) said margin portion having a support section thereof oriented longitudinally relative to said container body; and (C) a plurality of rib structures disposed on said margin and having longitudinally extending first rib components located on said support section and positioned in spaced-apart relation therearound, said rib structures being formed as tear-dropped shaped depressions defining trough regions alternating with ridge regions of such size and spacing that the trough regions are generally equal in area as the ridge regions.

2. An improvement according to claim 1 wherein said support section is a shell formed as a truncated geometric shape.

3. An improvement according to claim 2 wherein said geometric shape is selected from a group consisting of:

(A) a cone having a circular base;

(B) a cone having an oval base; and (C) a pyramid having a polygonal base of n sides wherein n is an integer greater than 2.

4. An improvement according to claim 1 wherein said one of said end closures is lid that is joined to said container body by a mechanical joint.

5. An improvement according to claim 4 wherein said margin portion has a U-shaped profile including an inner wall portion and an outer wall portion, said rib structures being disposed on said outer wall portion.

6. An improvement according to claim 1 wherein said container body has a cross-section that is selected from a group consisting of circles, ovals and n-sided polygons wherein n is an integer that is greater than 2.

7. An improvement according to claim 6 wherein said central body panel has a geometrical shape that is geometrically similar to the cross-section of said container body.

8. An improvement according to claim 1 wherein said ribs are formed as flutes in said support section.

9. An improvement according to claim 1 wherein at least some of said rib structures include radial second rib components disposed on said central body panel.

10. An improvement according to claim 1 wherein said first rib components are equidistantly spaced from one another.

11. A can body adapted to receive contents for packaging, comprising:

(A) a surrounding side wall portion having a central axis; and (B) a bottom closure joined to said side wall portion to enclose an end of the can body, said bottom closure including:

(1) a central body panel oriented transversely to the central axis and (2) an outer surrounding margin portion joined to said side wall, (a) said margin portion having a support section thereof oriented longitudinally relative to said surrounding side wall body; and (C) a plurality of rib structures disposed on said margin and having longitudinally extending first rib components:

(1) located on said support section and (2) positioned in spaced-apart relation about said support section, said rib structures being formed as tear-dropped shaped depressions defining trough regions alternating with ridge regions of such size and spacing that the trough regions are generally equal in area as the ridge regions.

12. A can body according to claim 11 wherein said margin portion has a U-shaped profile including an inner wall portion and an outer wall portion, said first rib components being disposed on said inner wall portion.

13. A can body according to claim 12 wherein said inner wall portion is formed as a truncated geometric shape.

14. A can body according to claim 13 wherein said geometric shape is selected from a group consisting of:

(A) a cone having a circular base;

(B) a cone having an oval base; and (C) a pyramid having a polygonal base of n sides wherein n is an integer greater than 2.

15. A can body according to claim 11 wherein said first rib components are formed as flutes in said support section.

16. A can body according to claim 11 wherein said bottom closure is formed integrally with said side wall portion as a one-piece construction.

17. A can body according to claim 11 wherein said side wall has a cross-section that is selected from a group consisting of circles, ovals and n-sided polygons wherein n is an integer that is greater than 2.

18. A can body according to claim 17 wherein said central body panel has a geometrical shape that is geometrically similar to the cross-section of said side wall.

19. A can body according to claim 11 wherein at least some of said rib structures include second rib components extending radially onto said central body panel.

20. A can body according to claim 11 wherein said first rib components are equidistantly spaced from one another.

21. A lid adapted to be seamed onto a can body that has a longitudinally extending central axis in order to form a container, comprising:

(A) a central body panel oriented transversely to the central axis and (B) an outer surrounding margin portion joined to said side wall, (1) said margin portion having a support section thereof oriented longitudinally relative to said container body; and (C) a plurality of rib structures disposed on said margin portion and having longitudinally extending first rib components located on said support section and positioned in spaced-apart relation therearound, said rib components being formed as tear-dropped shaped depressions defining trough regions alternating with ridge regions of such size and spacing that the trough regions are generally equal in area as the ridge regions.

22. A lid according to claim 21 wherein said margin portion has a U-shaped profile including an inner wall portion and an outer wall portion, said rib structures being disposed on said outer wall portion.

23. A lid according to claim 21 wherein said central body panel has a shape that is selected from a group consisting of circles, ovals and n-sided polygons wherein n is an integer that is greater than 2.

24. A lid according to claim 21 wherein said ribs are formed as flutes in said support section.

25. A lid according to claim 21 wherein said first rib components are equidistantly spaced from one another.

26. In a container having a surrounding side wall forming a container body that has a central axis and first and second end closures defining an interior therein, an improvement wherein at least one of said end closures includes:

(A) a central body panel oriented transversely to the central axis and (B) an outer surrounding margin portion joined to said side wall, (1) said margin portion having a support section thereof oriented longitudinally relative to said container body, said support section being corrugated so as to have trough regions formed as tear-dropped shaped depressions separated by ridge regions; and (C) a plurality of rib structures disposed on said margin and having longitudinally extending first rib components located on said support section and positioned in spaced-apart relation therearound.

* * * * *